US005687655A

United States Patent [19]

Weinschenk, Jr. et al.

[11] Patent Number: 5,687,655

[45] Date of Patent: Nov. 18, 1997

[54] ADJUSTABLE HEIGHT LOAD BEARING SUPPORT STRUCTURE

[75] Inventors: Lavern L. Weinschenk, Jr., Davenport; Jay R. Machael, Muscatine, both of Iowa

[73] Assignee: HON Industries Inc., Muscatine, Iowa

[21] Appl. No.: 634,592

[22] Filed: Apr. 18, 1996

[51] Int. Cl.[6] ..... A47B 9/00

[52] U.S. Cl. ..... 108/147; 248/162.1

[58] Field of Search ..... 108/147, 146, 108/145, 144, 141; 248/188.2, 162.1, 161, 575, 579, 588

[56] References Cited

U.S. PATENT DOCUMENTS

| | | | |
|---|---|---|---|
| 382,077 | 5/1888 | Dick | 108/147 X |
| 2,581,023 | 1/1952 | Jerick | 108/145 X |
| 2,590,859 | 4/1952 | Hickman . | |
| 2,605,987 | 8/1952 | Brown et al. . | |
| 2,881,465 | 4/1959 | Duff . | |
| 2,935,160 | 5/1960 | Lawson . | |
| 2,947,019 | 8/1960 | Liesse . | |
| 3,177,975 | 4/1965 | Galli . | |
| 3,207,496 | 9/1965 | Hrebicek . | |
| 3,370,556 | 2/1968 | Kooi . | |
| 3,415,586 | 12/1968 | Hammond | 108/147 X |
| 3,685,779 | 8/1972 | Papritz . | |
| 3,885,846 | 5/1975 | Chuang et al. . | |
| 4,026,222 | 5/1977 | Mueller . | |
| 4,381,714 | 5/1983 | Henneberg et al. . | |
| 4,400,186 | 8/1983 | Leuing et al. . | |
| 4,515,087 | 5/1985 | Kurrasch . | |
| 4,607,577 | 8/1986 | Leonardo | 108/144 |
| 4,619,208 | 10/1986 | Kurrasch . | |
| 4,640,488 | 2/1987 | Sakamoto | 108/145 X |
| 4,655,466 | 4/1987 | Hanaoka | 108/145 X |
| 4,712,653 | 12/1987 | Franklin et al. | 108/145 X |
| 4,768,762 | 9/1988 | Lund . | |
| 4,898,103 | 2/1990 | Pontoppidan et al. . | |
| 4,926,760 | 5/1990 | Sack | 108/145 |
| 5,018,700 | 5/1991 | Hardtke . | |
| 5,174,223 | 12/1992 | Nagy et al. . | |
| 5,236,171 | 8/1993 | Holmquist . | |
| 5,337,678 | 8/1994 | Grout . | |
| 5,341,542 | 8/1994 | Hannan et al. . | |
| 5,351,941 | 10/1994 | Hwang . | |
| 5,394,809 | 3/1995 | Feldpausch et al. . | |
| 5,456,191 | 10/1995 | Hall | 248/162.1 X |

FOREIGN PATENT DOCUMENTS

| | | | |
|---|---|---|---|
| 2717452 | 10/1978 | Germany | 108/145 |

*Primary Examiner*—Jose V. Chen

*Attorney, Agent, or Firm*—Jones, Day, Reavis & Pogue

[57] ABSTRACT

A height adjustable load support structure has a base frame and a generally planar support surface. Preferably, two extendable vertical support assemblies support the surface for vertical movement relative to the base frame. Each support assembly is engaged by a spring biased pivotable arm to counterbalance the weight placed on the surface. A cam system cooperating between the distal ends of the pivotable arms and the support assemblies serves to compensate for the changing spring force on the arms by varying the effective moment arms of the arms thereby equalizing the force on each support assembly through its complete range of vertical travel.

24 Claims, 13 Drawing Sheets

ADJUSTABLE HEIGHT LOAD BEARING SUPPORT STRUCTURE

BACKGROUND OF THE INVENTION

1. Field of the Invention

The present invention relates generally to a load bearing support which is adjustable in height and, more particularly, to a load bearing member which is counterbalanced in a manner such that it can be adjusted to an equilibrium condition for a specific load placed on it whereby the load may be raised or lowered as though weightless through its entire vertical path of travel.

2. Description of the Prior Art

In many applications it is desirable to support a load of some type such that the load may be conveniently raised or lowered. In the contemporary design of office environments, for example, it has been found desirable to sometimes provide tables or desks having work surfaces which are height adjustable. In fact, increasing numbers of people who work in office environments prefer to alter the height of their desk surfaces from a level at which they can be seated in a chair to a level at which they can work while standing. Such height adjustability allows the worker to vary his or her body position and avoid fatigue associated with being confined to a single posture over an extended period of time.

Increasingly, more and more office workers use computers in the course of their normal duties and have their computers placed on their desks. Particularly if the computer monitor and central processing unit are placed on the desk, these items can add considerable weight to the desk surface. Thus, where the desk surface is height adjustable, it is essential that some means be provided for counterbalancing the desk surface so that the user does not need to exert the considerable force which would be needed to raise the desk work surface and associated equipment.

Many systems are known for counterbalancing height adjustable support structures. Early forms of such systems may be found in the drafting table art wherein it is often desirable to have a height adjustable drawing surface. Drafting tables are known, for example, which use forms of parallelogram linkage mechanisms or cable and pulley arrangements and wherein extension springs are used to counterbalance the work surface. However, these arrangements are typically not adjustable in any way to compensate for added weight placed on the work surface. Hence, they are generally unsuitable for use in a height adjustable desk capable of supporting the added weight of a computer or other office equipment. Moreover, they would not provide for counterbalanced work surface support over the full range of vertical adjustment of the surface because the force of the counterbalancing springs changes significantly as the springs are extended.

Attempts have been made to design height adjustable load support members which are counterbalanced in a manner as to also be adjustable to balance differing loads placed on the support surface. Once such example of an adjustable load supporting device is disclosed in Holmquist, U.S. Pat. No. 5,236,171, issued Aug. 17, 1993. In that patent, a linkage system is disclosed which is connected to a gas spring. The spring has its opposed ends adjustable along linkage members to exert greater or lesser force on a work surface support member thereby compensating for the load on the associated support surface. However, a disadvantage of that device is that both ends of the spring must be adjusted to compensate for different loads. Moreover, in practice, two such gas springs must be employed, one for each side of the support surface. Thus, when this device is used as a height adjustable desk for example, four separate adjustments must be made if greater or lesser load is placed on the work surface and the load is to be effectively counterbalanced. Moreover, it is not self explanatory how such four adjustments should be made for any given load condition. Thus, as a practical matter, this arrangement is undesirable for use as a consumer product in which relative simplicity of operation is preferred.

Accordingly, it is desirable to provide a height adjustable load support structure which is capable of being adjusted to counterbalance additional weight placed on its support surface such as the weight of equipment or the like. It is further desirable to provide such a load support structure wherein the counterbalancing mechanism, once adjusted for the weight placed on the support surface, allows for effortless height adjustability through the entire range of vertical movement of the support surface. Still further it is desirable to provide such a load support structure which can be adjusted conveniently without tools or the like and without the need for complicated and hard to understand adjustment mechanisms. Further it is desirable to provide such a load support structure which is safe to use and has an aesthetically pleasing visual appearance such that it can be used advantageously as an office table or desk.

SUMMARY OF THE INVENTION

The present invention overcomes the disadvantages of the prior art by providing a height adjustable load support structure having a base frame and a generally planar support surface. Preferably, two extendable vertical support assemblies support the surface for vertical movement relative to base frame. Each support assembly is engaged by a spring biased pivotable arm to counterbalance the weight placed on the work surface. A cam system cooperating between the distal ends of the pivotable arms and the support assemblies serves to compensate for the changing spring force on the arms by varying the effective moment arms of the arms thereby equalizing the force on each support assembly through its complete range of vertical travel.

BRIEF DESCRIPTION OF THE DRAWINGS

The foregoing and other novel features and advantages of the invention will be better understood upon a reading of the following detailed description taken in conjunction with the accompanying drawings in which.

DETAILED DESCRIPTION OF THE PREFERRED EMBODIMENTS

Although the present invention will be described hereinafter in the context of an adjustable height table for office use, it will be appreciated that the invention is equally applicable to load bearing structures of many different types useable in a variety of different applications.

Figure 1:
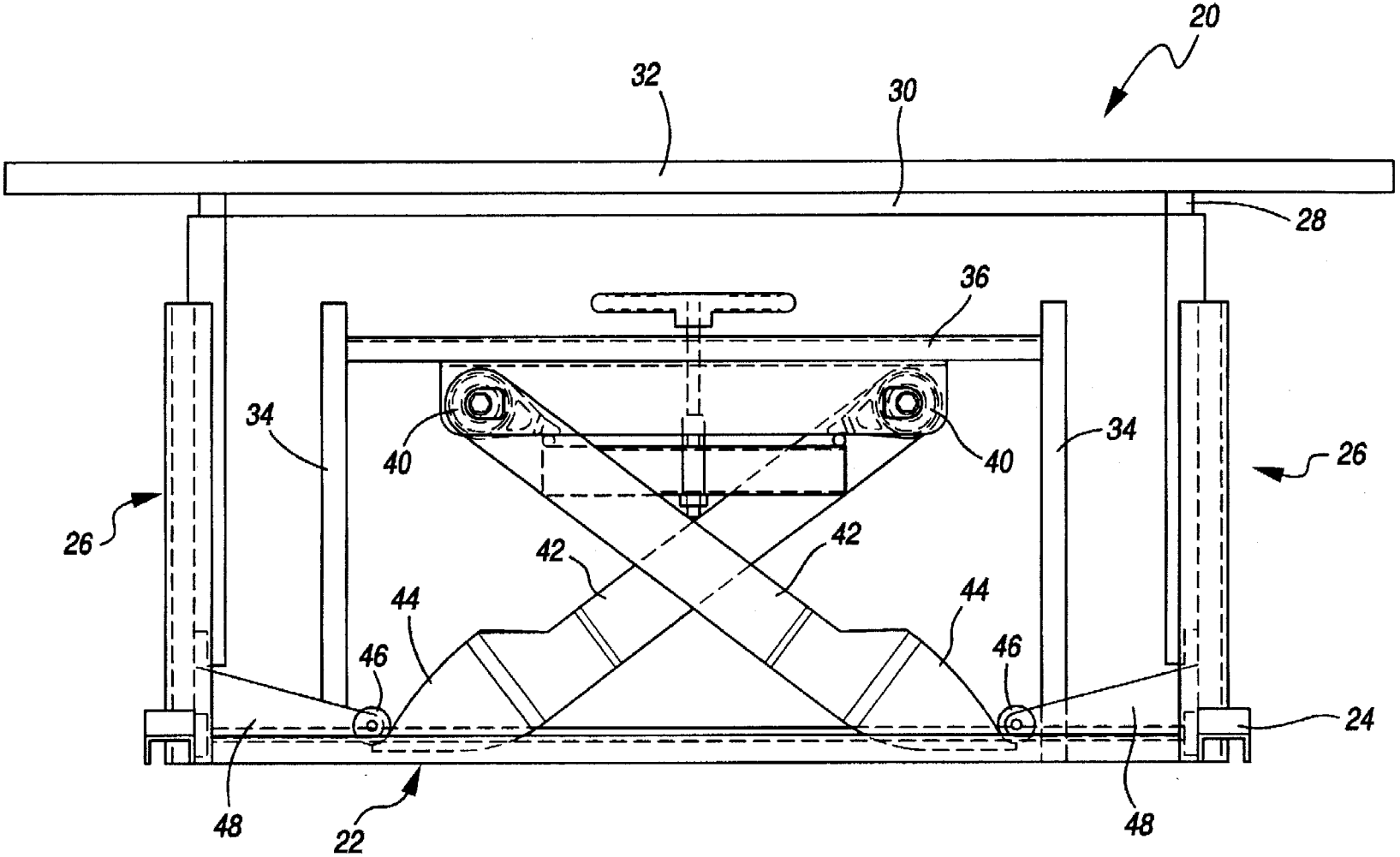
FIG. 1 is a front elevational view of a table constructed in accordance with the principles of the invention.
Figure 2:
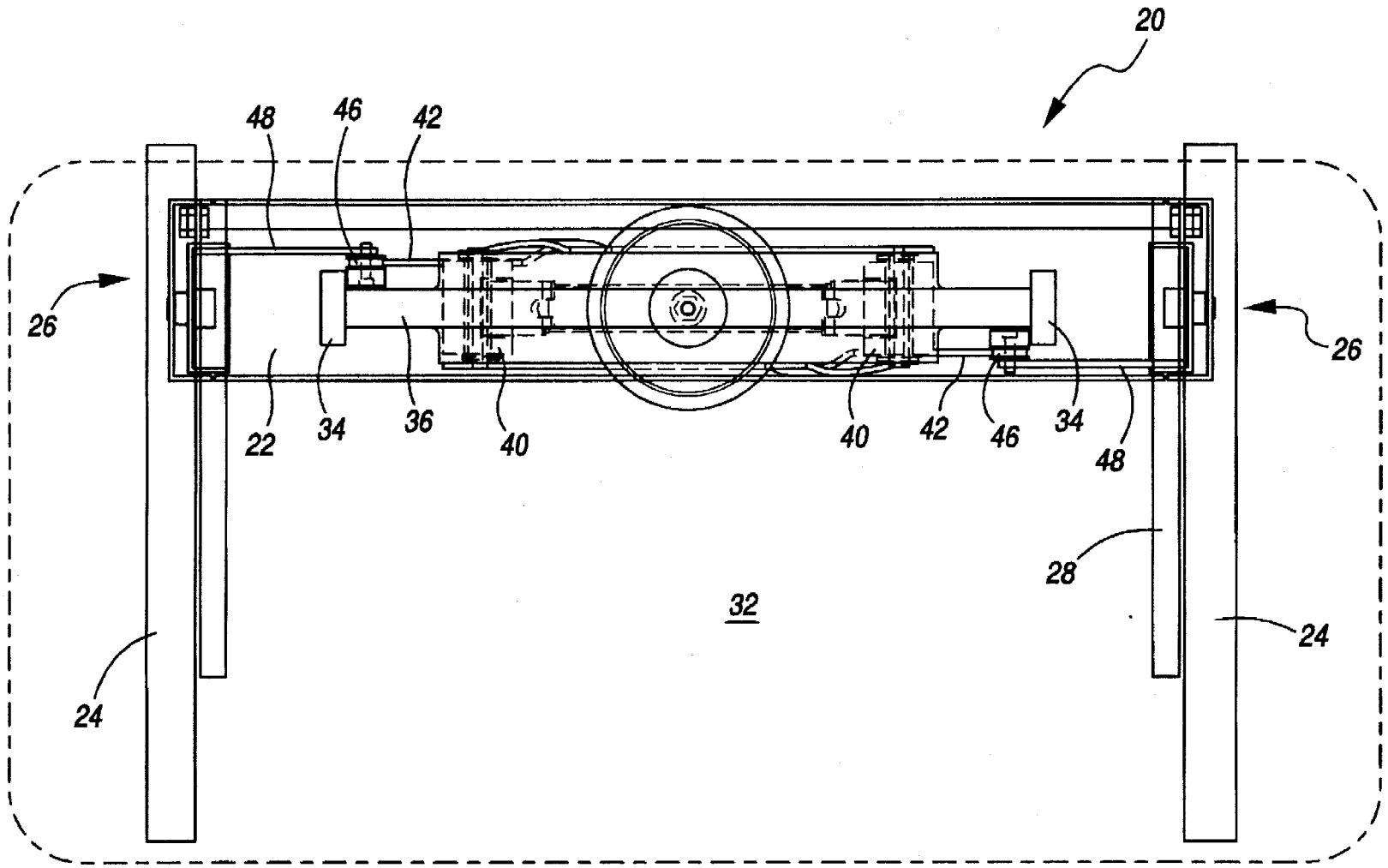
FIG. 2 is top plan view thereof.
Figure 3:
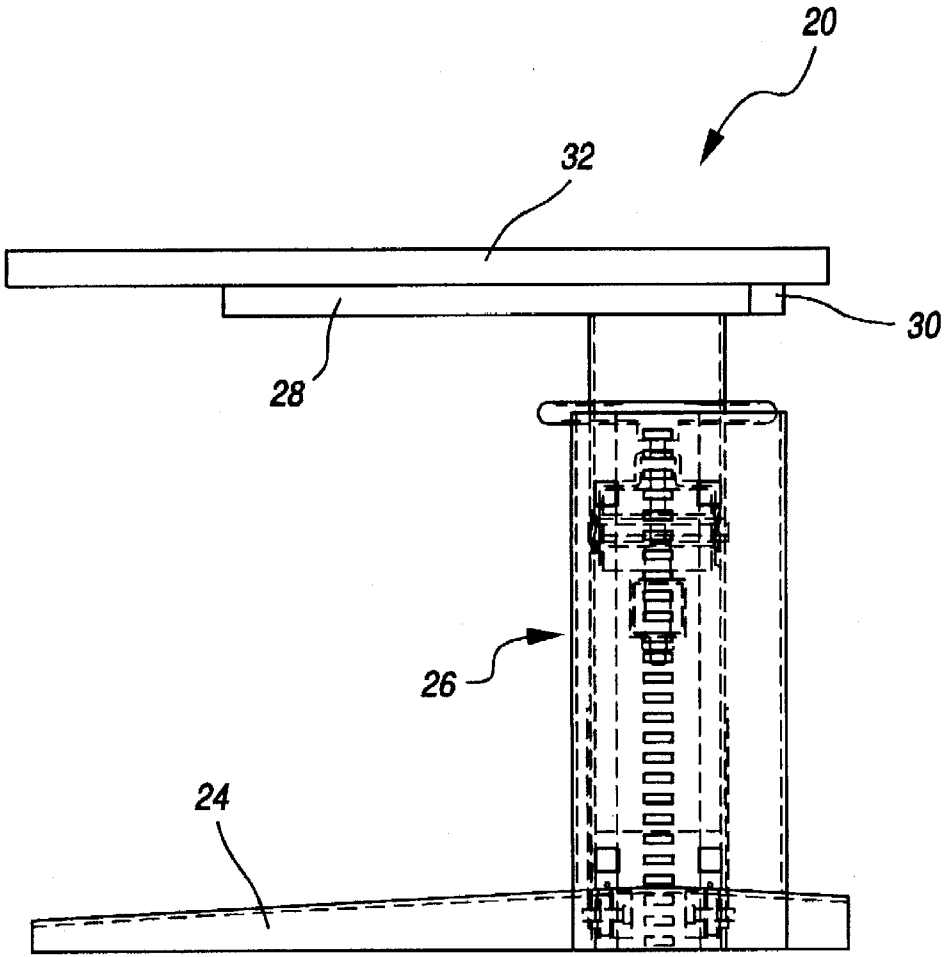
FIG. 3 is a right side elevational view thereof.

Referring now to the drawings, and initially to FIGS. 1–3, an adjustable height table is designated generally by the reference numeral 20 and includes a base frame 22 including a pair of opposed legs 24. Supported on the frame 22 are a pair of extendable upright support assemblies 26 which will be described in detail hereinafter. At the upper ends of each assembly 26 a forwardly extending arm 28 is provided. The arms 28 are connected by a cross brace 30 which together serve to support a suitable work surface 32.

Positioned beneath the work surface 32 and attached to the base frame 22 as by welding is a support structure comprising two vertical tubes 34 and a connecting cross brace 36. The cross brace 36 supports a pair of elastomer torsion springs 40 each connected to a generally elongate arm 42 which extends diagonally beneath the work surface 32. The distal end of each arm is provided with a cam surface 44 on which a roller 46 rides. The rollers 46 are journaled for free rotation on brackets 48 connected to the upright assemblies 26 as will be described hereinafter. The rollers 46 have dual roller surfaces, one of which rides on the cam surface 44 and the other of which rides on the vertical tubes 34. In this way the vertical tubes 34 resist lateral forces placed on the brackets 48 as the rollers 46 ride on the cam surfaces 44.

Figure 4:
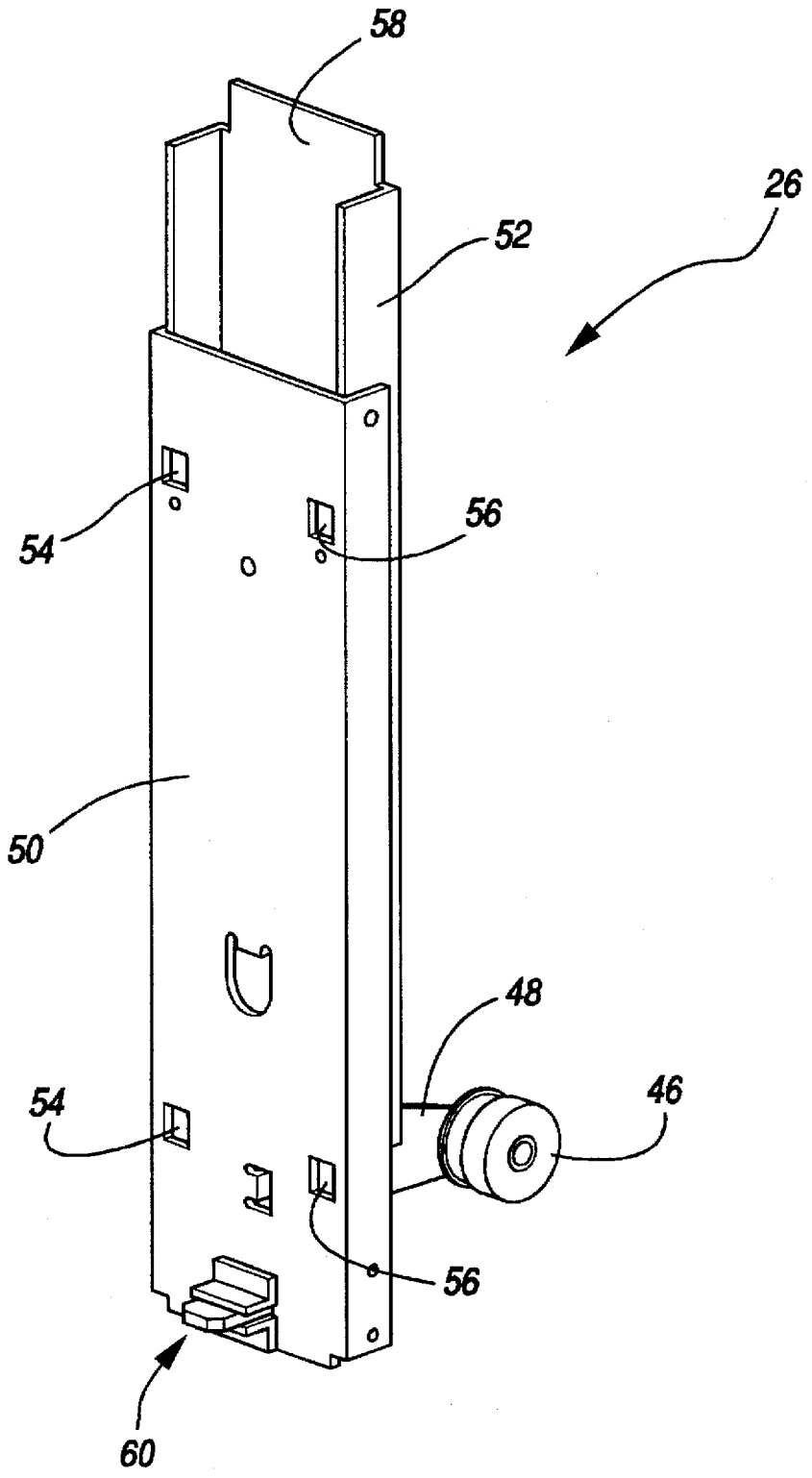
FIG. 4 is a perspective view of work surface support assembly constructed according to the principles of the invention.
Figure 5:
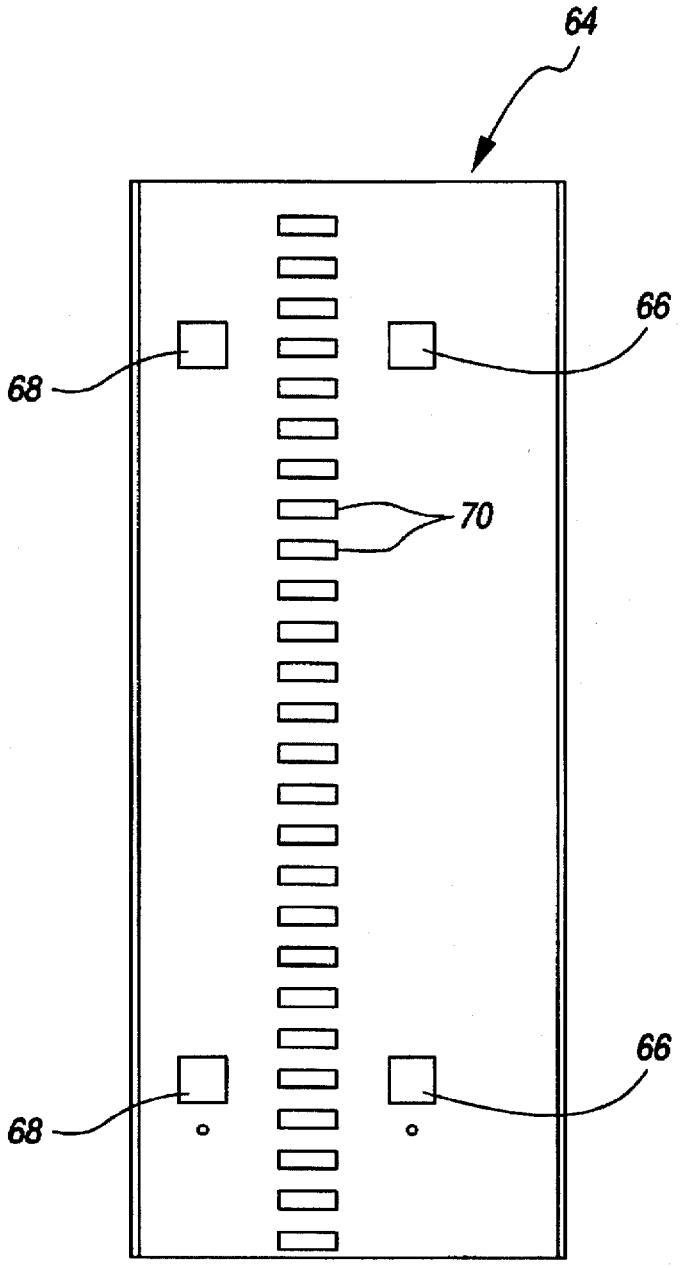
FIG. 5 is a front view of a channel member for cooperation with the work surface support assembly.
Figure 6:
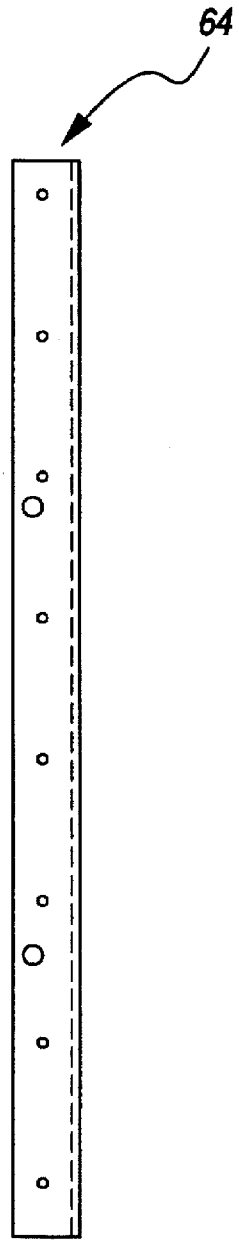
FIG. 6 is a side view thereof.

The construction of the upright assemblies 26 can be seen in FIG. 4. Each assembly 26 includes two C-shaped channel members 50 and 52 preferably bolted together with member 52 slidingly received within member 50. This sliding configuration allows the assembly 26 to be manually adjusted for differing ultimate heights of the work surface 32. The roller bracket 48 is preferably welded to the inside of the channel member 50. The channel member 50 is provided with pairs of spaced rectangular apertures 54 and 56 for receiving lanced tabs of ball bearing slide assemblies as will be hereinafter described. The upper end of member 52 is provided with a flange 58 to which each arm 28 is welded. A latch assembly 60 as will be described is provided at the lower end of the member 50. The assemblies 26 further include a generally C-shaped channel member 64 which is preferably welded to legs 24 of the base frame 22. As best seen in FIGS. 5 and 6, these channel members 64 include pairs of spaced rectangular apertures 66 and 68 and a series of aligned closely spaced slots 70.

Figure 7:
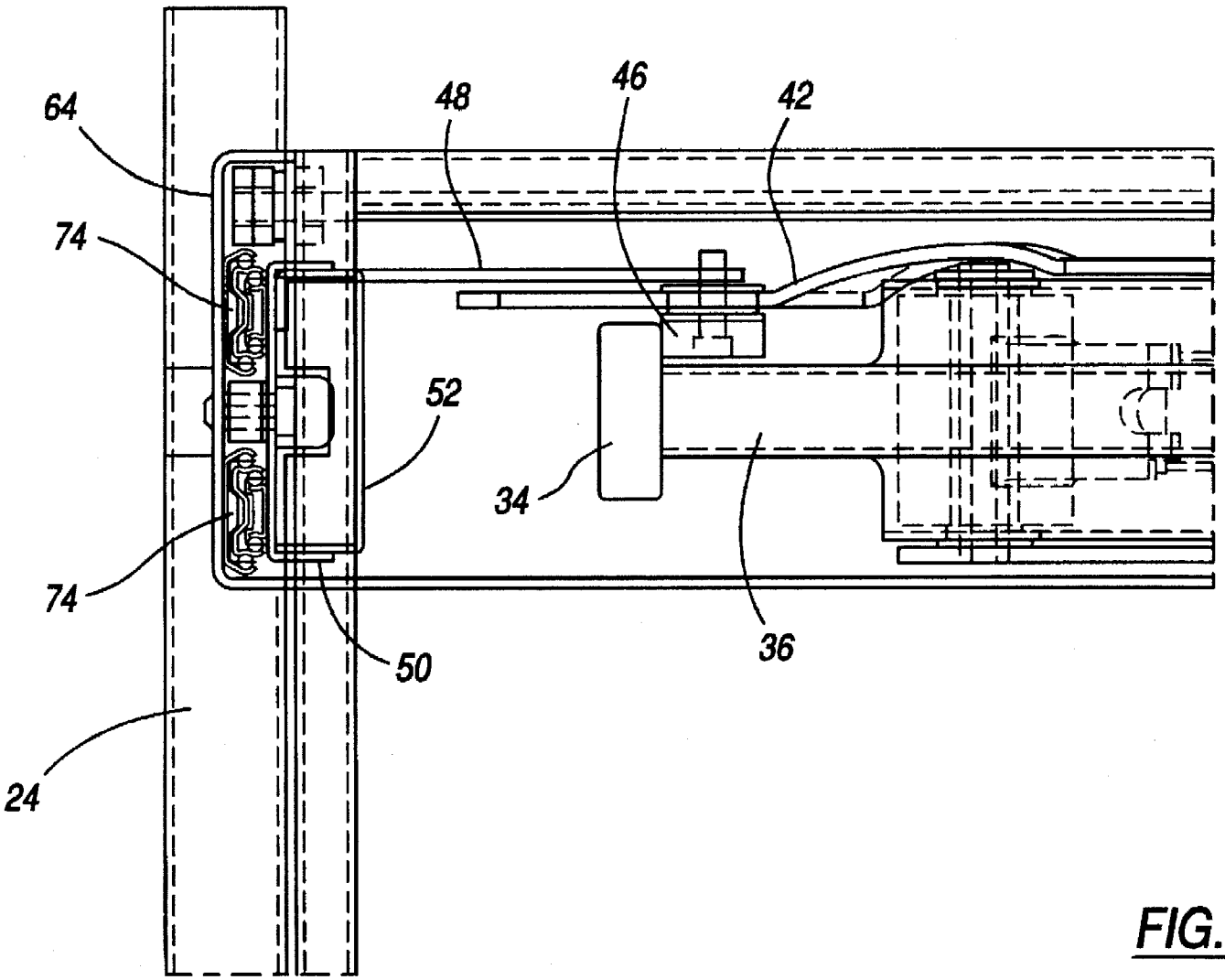
FIG. 7 is a partial top view illustrating the component parts of the work surface support assembly.
Figure 8:
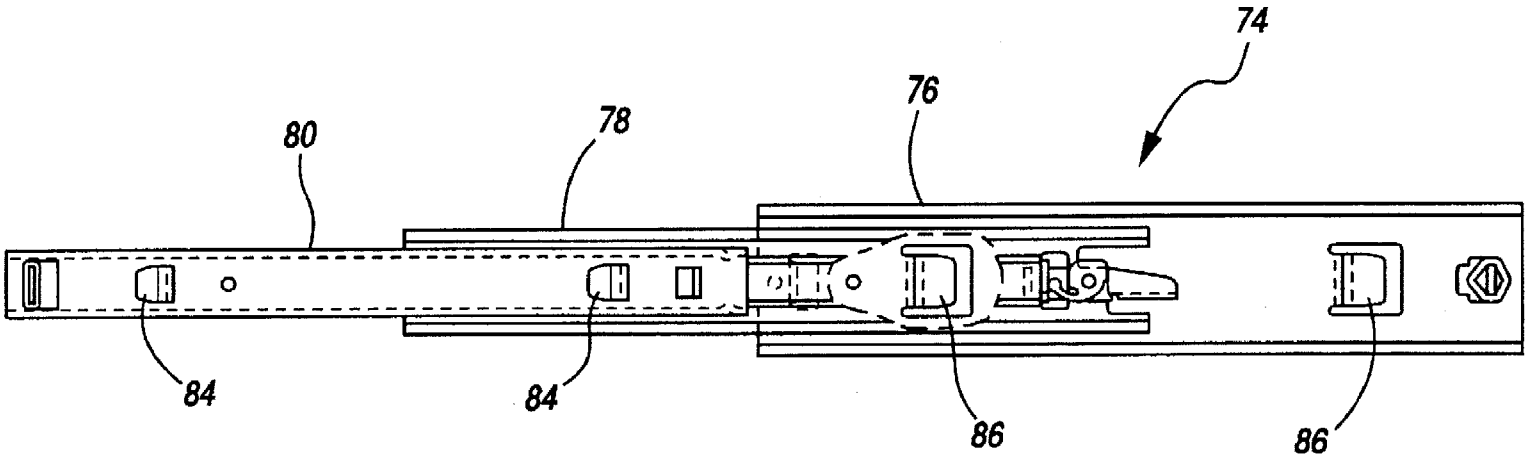
FIG. 8 is a plan view of a slide assembly for supporting the work surface of the table.
Figure 9:
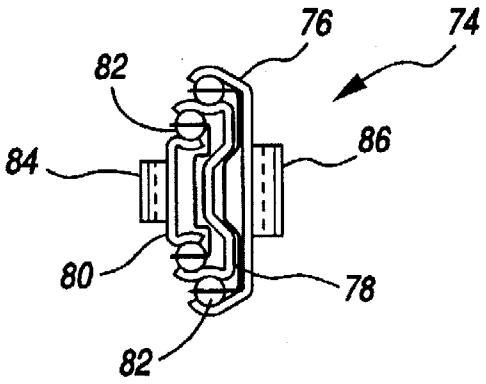
FIG. 9 is an end view thereof.

The assembled condition of the uprights 26 is best seen in the top view of FIG. 7 wherein a pair of ball bearing slide assemblies 74 are disposed between the channel member 64 and the member 50. Each slide assembly 74 may be of a type well known in the art for use in cabinetry, and best seen in FIGS. 8 and 9, consisting of three track members 76, 78 and 80 which freely slide on suitable ball bearings 82. The innermost track 80 is provided with lanced tabs 84 which engage the aforementioned apertures 54 and 56 of the channel member 50. Likewise, the outermost track 76 is provided with lanced tabs 86 which engage the apertures 66 and 68 of the channel members 64. By this arrangement, pairs of slide assemblies 74 may be readily installed in the upright assemblies 26 and secured in proper place by suitable sheet metal screws.

Figure 10:
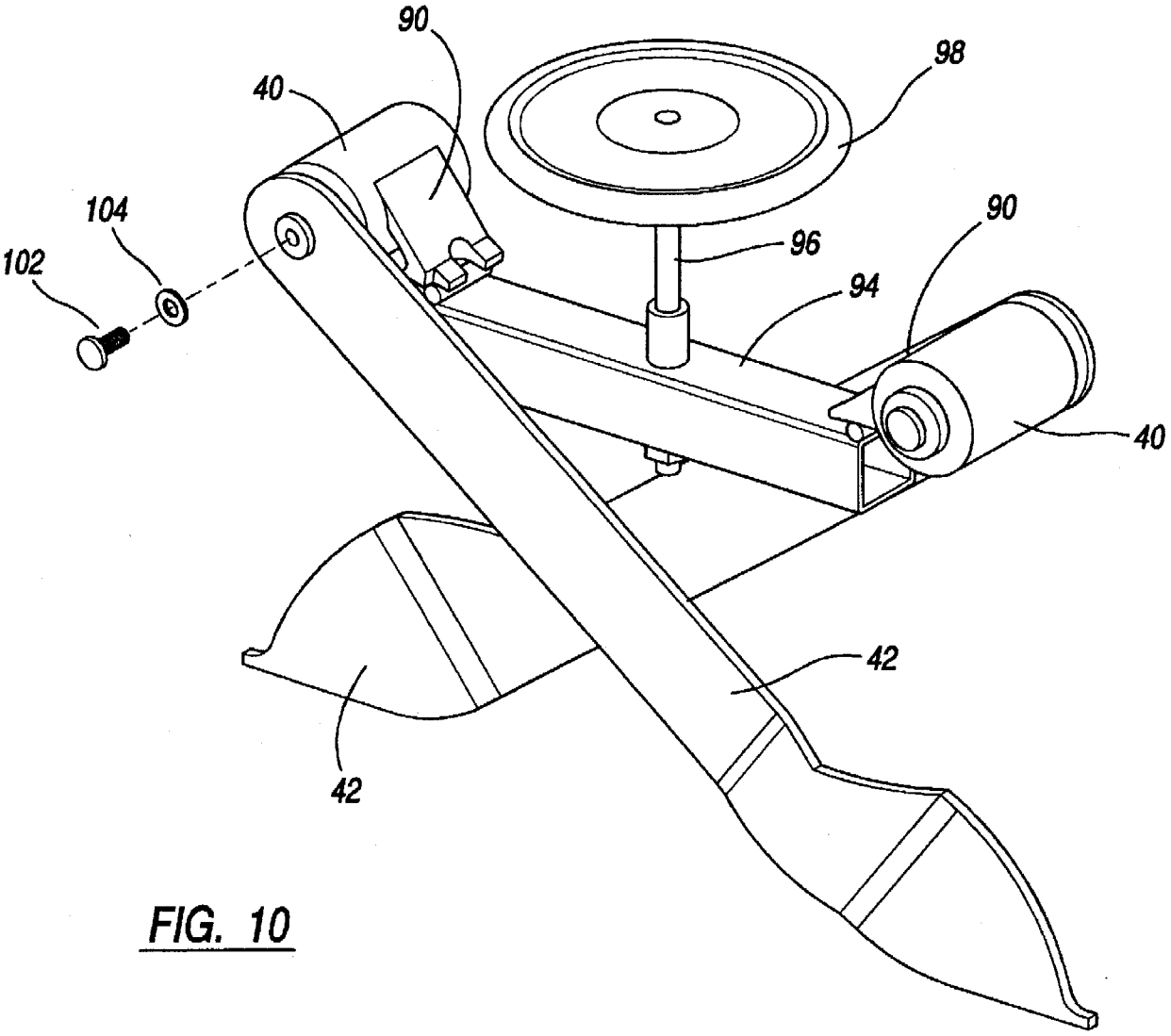
FIG. 10 is a perspective view illustrating the counterbalancing mechanism of the table.
Figure 11:
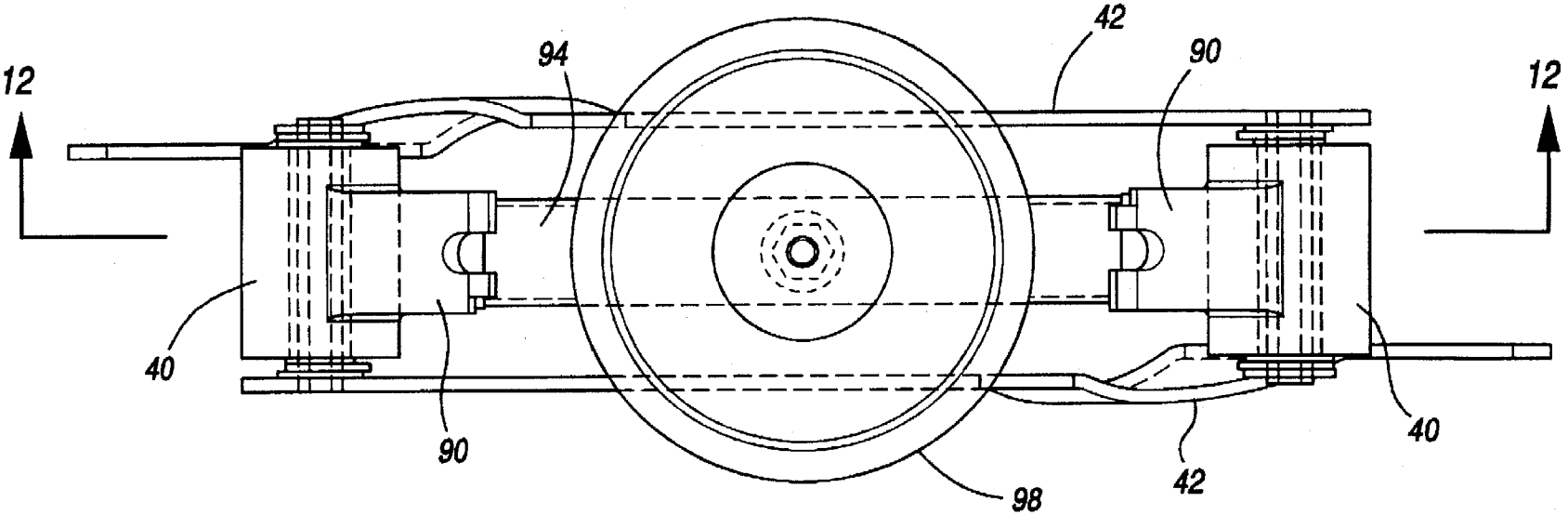
FIG. 11 is a top plan view of the counterbalancing mechanism.
Figure 12:
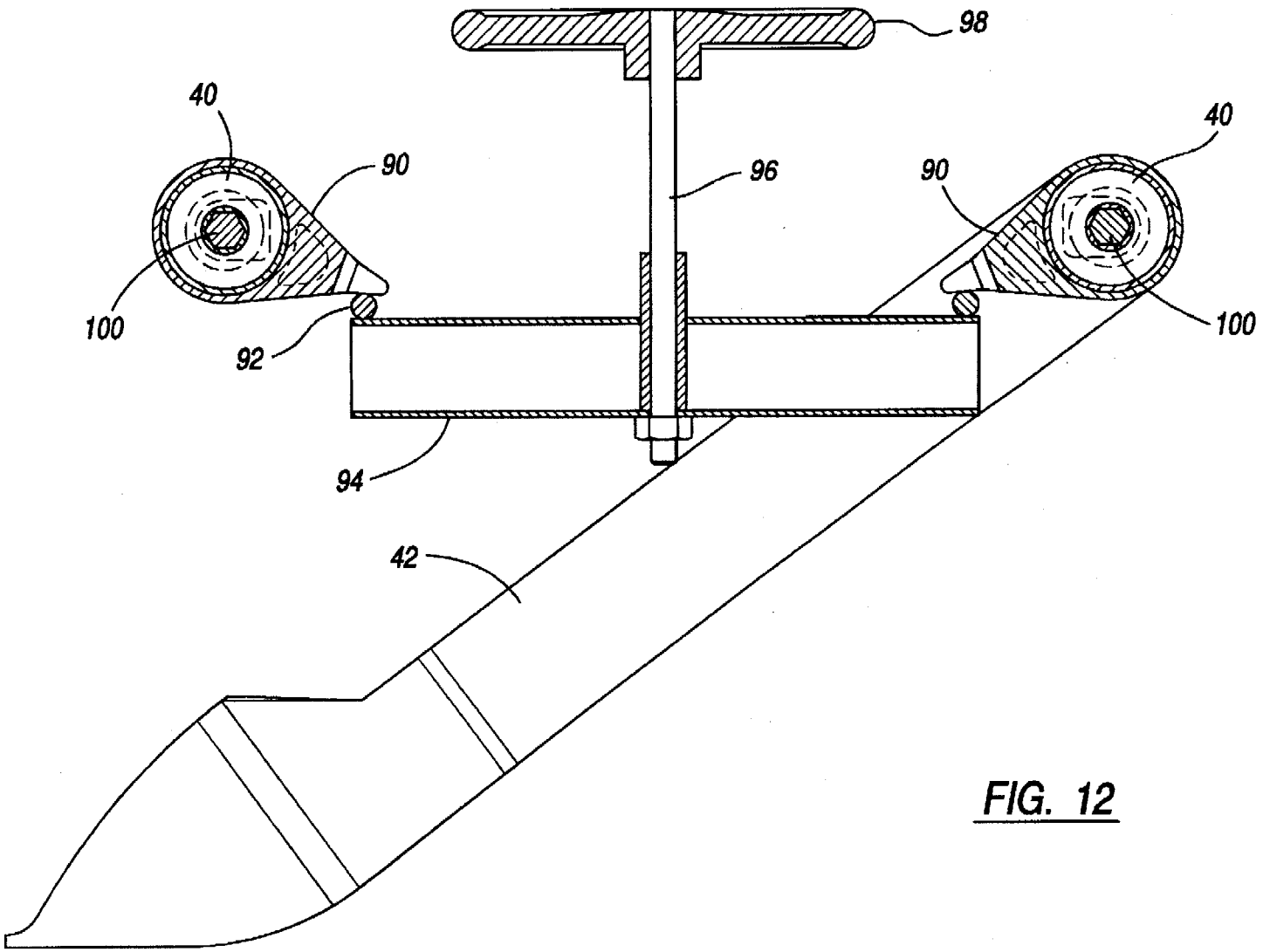
FIG. 12 is a cross-sectional view taken substantially along the line 12—12 of FIG. 11.
Figure 13:
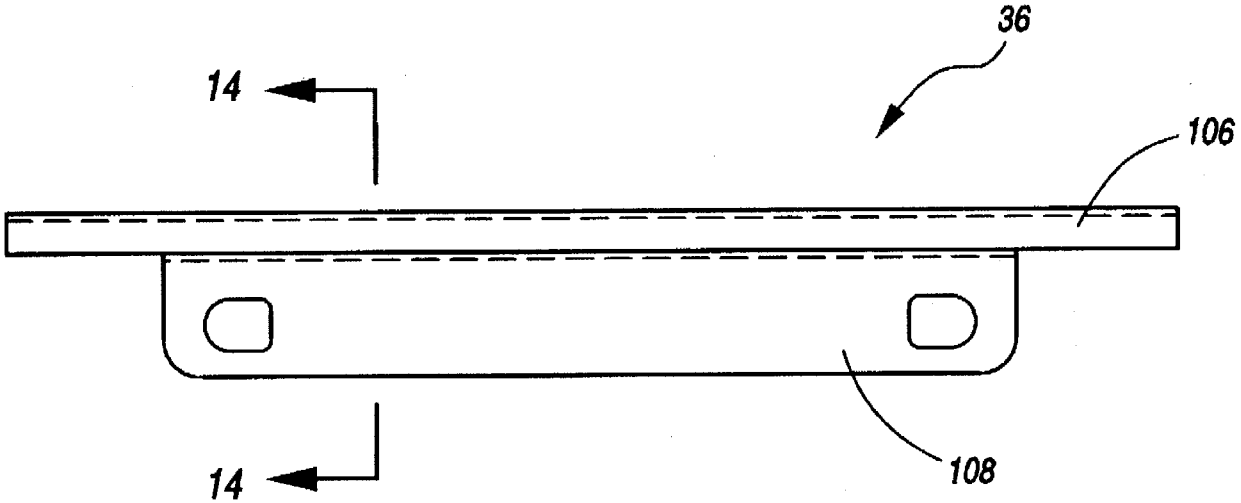
FIG. 13 is a side view of a support channel for supporting the counterbalancing mechanism.
Figure 14:
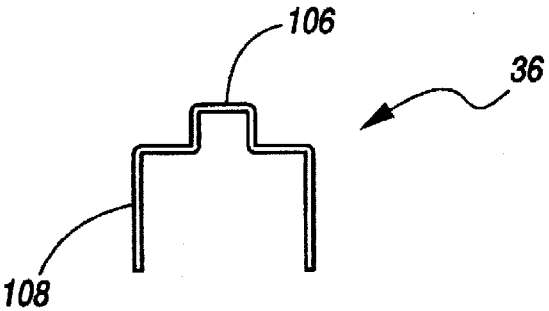
FIG. 14 is a cross-sectional view taken substantially along the line 12—12 of FIG. 13.

The function of the arms 42 in counterbalancing the work surface 32 can best be seen in FIGS. 10, 11 and 12. The elastomeric springs 40 are provided with arms 90 extending from one side thereof which are each engaged by bearing rods 92 welded to a cross tube 94. A threaded shaft 96 connected to a hand wheel 98 may be manually turned to increase or decrease the tension of the two spring 40 thereby altering the spring force on the counterbalancing arms 42. The connection between the arms 42 and springs 40 is preferably made by hexagonal cross-section shafts 100 to which the arms 42 are fastened by suitable screws 102 and associated washers 104. The cross brace 36 which supports the springs 40 and the associated tension adjustment members is shown in FIGS. 13 and 14 and can be seen to be an integrally stamped and formed member having a first narrow channel portion 106 and a wide lower channel portion 108.

Figure 17:
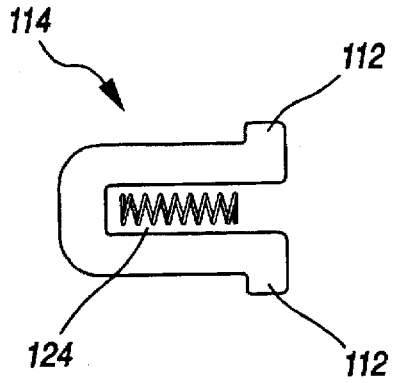
FIG. 17 is a plan view of a latch bar as used in the latch mechanism.
Figure 16:
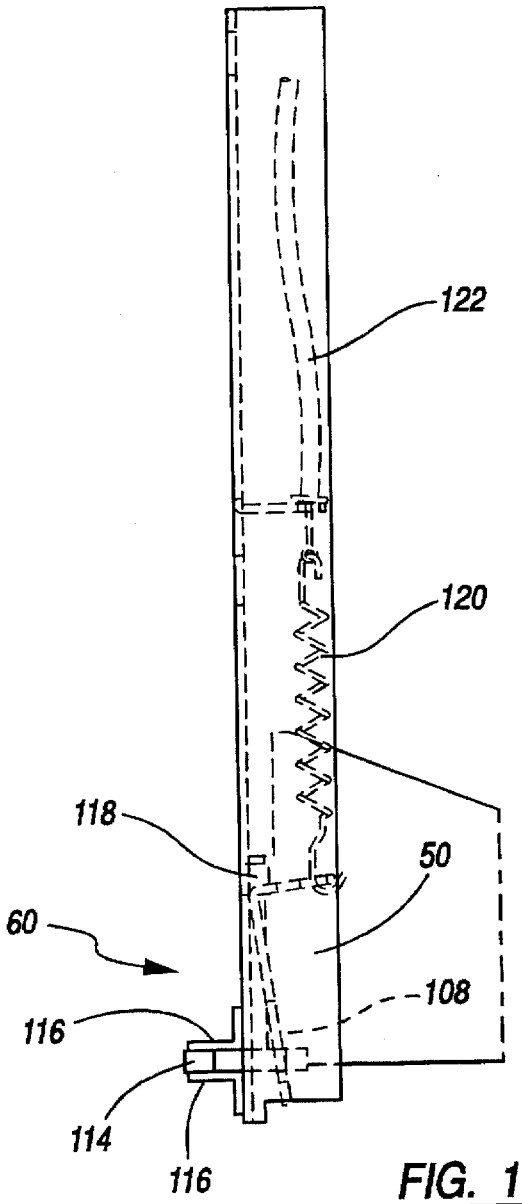
FIG. 16 is a side view thereof.
Figure 15:
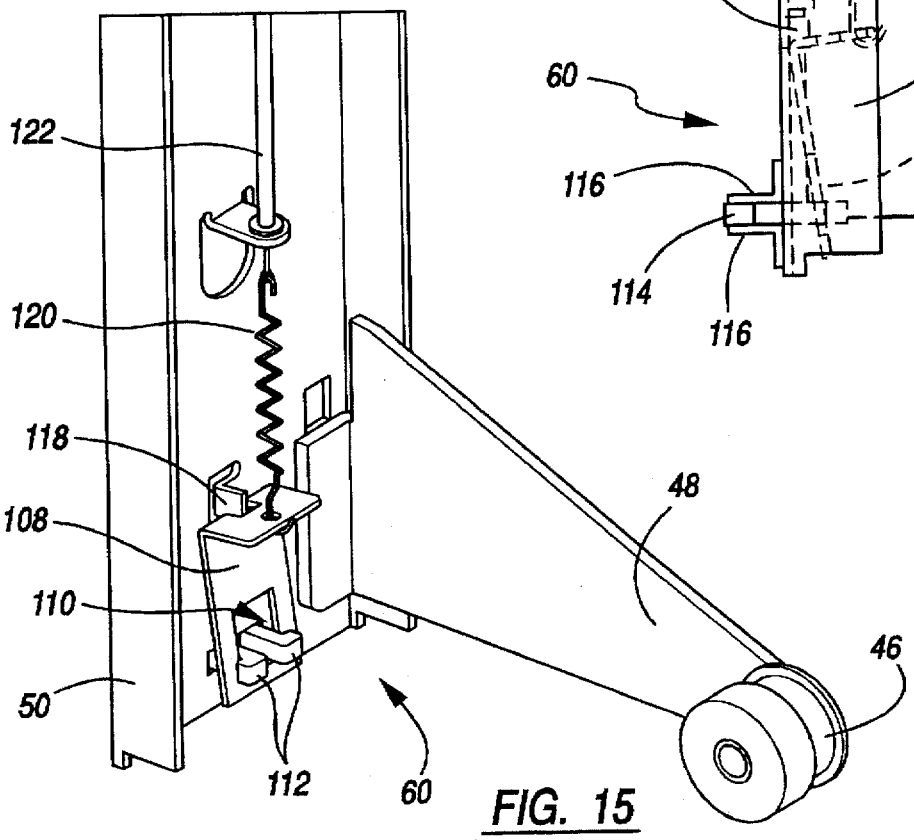
FIG. 15 is a partial perspective view illustrating the latch mechanism of the present invention.

An important feature of the invention is the latch assembly 60 best illustrated in FIGS. 15–17. The latch assembly 60 includes an L-shaped bracket 108 having an aperture 110 which engages ears 112 of a latch bar 114. The ears 112 each project through an aperture of the channel member 50 and the bar 114 is guided by a pair of L-shaped supports 116 extending from the outwardly directed side of the channel member 50. A tab 118 struck from the channel member 50 is received by a slot formed in the bracket 108 permitting the bracket 108 to rock under the action of a suitable spring 120 and associated cable 122. The latch bar 114 is normally biased outwardly by a spring 124 which bears against the channel member 50. When the cable is relaxed, the latch bar 114 will project outwardly of the supports 116 a sufficient distance to engage a selected slot 70 of the channel member 64. The work surface 32 may thereby be effectively locked in a plurality of vertical positions relative to the floor of the surrounding room.

Figure 18:
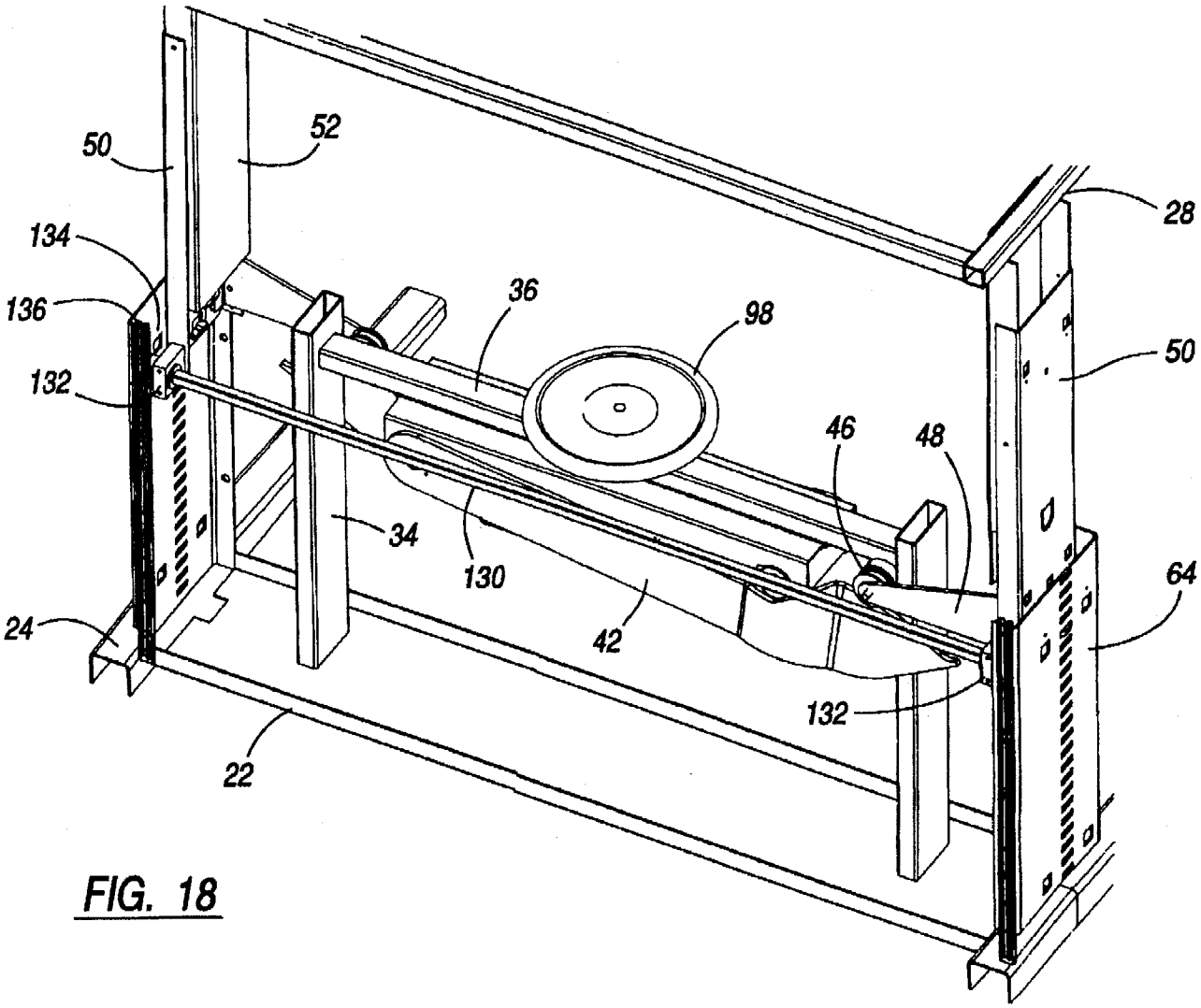
FIG. 18 is a rear perspective view of a table in accordance with the invention illustrating the work surface elevated to its uppermost position.

Operation of the table 20 can best be seen in the perspective view of FIG. 18. In this view the table 20 is shown in a fully upwardly extended position. The slide assemblies 74 are removed for clarity. In this position, the arms 42 have biased the support assemblies 26 upwardly directed force on the brackets 48. The rollers 46 have followed the cam surfaces 44 of the arms 42 to a position closer to the pivot shafts 100 of the arms 42. Thus, as the torsion springs 40 unwind and exert lesser force on the arms 42 the effective moment arm of each arm 42 is reduced causing the resultant force on the brackets 48 to be equalized throughout the range of vertical travel of the work surface 32. As weight is placed on the work surface 32, such as computer equipment or the like, the spring 40 force may be increased by turning the hand wheel 98 and tensioning the springs 40 to any desired condition. Thereby, the work surface 32 may be counterbalanced for a variety of loads placed thereon such that it can be raised or lowered as desired by the table 20 user with relative ease once the springs 40 are preadjusted for the weight of the load.

It can be appreciated that loads placed on the work surface 32 may be off-center of the work surface. Thus, to accommodate uneven loading of the work surface 32 and permit both support assemblies 26 to raise and lower at the same rate and without binding a system may be employed such as rack and pinion gearing to synchronize movement of the support assemblies 26. As shown in FIG. 18 such a system may include a shaft 130 supported on the channels 50 by suitable bearings 132 and heaving spur gears 134 which engage vertical gear racks 136 mounted to the channels 64. Such a system will assure that both support assemblies 26 move evenly at the same rate despite off-center loading.

In constructing the counterbalance assembly we have found through experimentation that the cam surfaces 44 of the arms 42 are preferably formed with a radius of curvature located in the direction of the base frame 22 of the table 20. The combination of the changing cam surface 44 angle and the changing moment arm result in a constant vertical component of force acting on the roller 46. By this arrangement the vertical component of force on the brackets 48, as compensated for a degree of lateral frictional force, will be very closely equalized through the entire range of vertical movement of the work surface 32, making it almost effortless to raise or lower the table height. A suitable elastomeric torsion spring 40 which performs well with the table 20 is available from Lord Corporation of Erie, Pa. However, a steel torsion spring will perform equally well. It can also be appreciated that the cable system 122 used to operate the latch 60 may be constructed to be either hand operated or foot operated. In one form of the invention the cable 122 from both sides of the table may be routed to a Y-connection beneath the work surface 32 as to be hand-operated by a suitable know (not shown).

An advantage of the invention is that the table 20 may be assembled with differing ranges of vertical height capability depending on the preferences of the user. This is possible simply by bolting the channel members 50 and 52 together at differing telescoping position. With the slide assembly 74 illustrated, the table may have a work surface height adjustment range from as low as 26 inches to 44 inches to greater than 30 inches to 48 inches. It is also important that the entire counterbalancing mechanism is located underneath the work surface 32 and toward the rear of the table 20. This distinguishes over tables having counterbalancing mechanisms located on the sides of the table which must be shrouded to avoid safety hazards and thus have an awkward appearance. The mechanism of the present table 20 may be shrouded to appear like a modesty panel which is a common feature of many expensive looking tables and desks.

While the invention has been described in connection with preferred embodiments thereof it will be apparent to those skilled in the art that many changes and modifications may be made without departing from the true spirit and scope of the invention. Accordingly, it is intended by the appended claims to cover all such changes and modifications as come within the true spirit and scope of the invention.

What is claimed is:

1. An adjustable height load bearing support structure comprising:

a base frame;

a generally planar support surface member;

support assembly means configured to support said support surface member for vertical movement relative to said base frame;

at least one arm biased by a spring, said spring imposing changing biasing force on said arm, said arm being pivotable about an axis disposed beneath said support surface member and having a free distal end; said arm further having an effective moment arm; and cam means provided at the distal end of said arm and cooperable with said support assembly means for biasing said support assembly means throughout a range of vertical travel and continuously varying the effective moment arm of said arm to compensate for the changing force of the spring biasing of said arm wherein an upward force imposed by said arm on said support assembly means is substantially constant through the range of vertical travel of said support assembly means.

2. The support structure of claim 1 wherein said arm is biased by a torsion spring disposed coaxially with said axis of the arm.

3. The support structure of claim 1 including means for adjusting biasing force of said spring on the arm such that the support surface member can be counterbalanced with different loads placed thereon.

4. The support structure of claim 1 including two spring biased pivotable arms cooperable with said support assembly means.

5. The support structure of claim 4 including means for simultaneously adjusting the biasing force on both pivotable arms.

6. The support structure of claim 5 wherein each arm is biased by a torsion spring having a laterally extending arm and said torsion spring arms are simultaneously engaged by an adjustable tube member to increase or decrease the biasing force on said pivotable arms.

7. The support structure of claim 4 wherein a first arm is pivoted about an axis spaced from an associated support assembly means with the pivot axis of a second arm disposed between the pivot axis of the first arm and a second associated support assembly means such that said arms cross one another.

8. The support structure of claim 1 wherein said cam means includes a cam member on said arm and a cooperating cam follower on said support assembly means wherein said cam follower rides on said cam member and the effective moment arm of said pivotable arm is altered throughout the range of movement of said support assembly means.

9. The support structure of claim 8 wherein said effective moment arm is increased as said support assembly means moves to a downward position to thereby compensate for increased biasing force of said arm.

10. The support structure of claim 8 wherein said effective moment arm is decreased as said support assembly means moves to an upward position to thereby compensate for decreased biasing force of said arm.

11. The support structure of claim 8 wherein said cam member has a curvilinear cam surface.

12. The support structure of claim 11 wherein said curvilinear surface has a center of curvature disposed below said cam surface.

13. The support structure of claim 8 wherein said cam follower is supported on said support assembly means by a bracket extending inwardly of said frame.

14. The support structure of claim 13 wherein said bracket supports a roller and said frame includes a vertical support tube in alignment with said roller wherein said roller rides on said tube to stabilize said support assembly means against lateral forces imposed thereon by said arm.

15. The support structure of claim 1 wherein said support assembly means includes extensible tracks.

16. The support structure of claim 1 wherein said support assembly means includes latches to retain said support surface in a desired vertical position.

17. The support structure of claim 16 wherein said latches are cable-operated.

18. The support structure of claim 1 wherein said arm is disposed beneath a rear portion of said support surface and extends from side to side relative to said support surface.

19. An adjustable height table comprising:

a base frame;

a generally planar work surface;

support assembly means configured to support opposed sides of said work surface for vertical movement of said work surface relative to said base frame;

a pair of arms each biased by a spring, said springs imposing changing biasing force on said arms, said arms being pivotable about axes disposed beneath said work surface, each arm having a distal end and an effective moment arm;

cam surfaces provided on the distal ends of said arms and cooperable with cam followers connected to said support assembly means for biasing said support assembly means throughout a range of vertical travel and continuously varying the effective moment arms of said arms to compensate for the changing force of the spring biasing of said arm wherein upward forces imposed by said arms on said support assembly means are substantially constant through the range of vertical travel of said support assembly means.

20. The table of claim 19 wherein the arms are biased by torsion springs.

21. The table of claim 19 including means for manually adjusting the biasing forces of the springs on the arms.

22. The table of claim 19 wherein said cam followers are supported on said support assembly means by brackets extending inwardly of said frame.

23. The table of claim 22 wherein said brackets support rollers and said frame includes a pair of vertical support tubes in alignment with said rollers wherein said rollers ride on said tube to stabilize said support assembly means against lateral forces imposed thereon by said cam surfaces.

24. The table of claim 19 wherein said support assembly means includes latches to retain said work surface in a desired vertical position.

* * * * *